US005336039A

United States Patent [19]

House

[11] Patent Number: 5,336,039

[45] Date of Patent: Aug. 9, 1994

[54] LIFT TRUCK PARALLEL ARM CLAMP FOR COMPATIBLY MAXIMIZING OPERATOR VISIBILITY AND LOAD-CARRYING CAPACITY

[75] Inventor: Marshall K. House, Portland, Oreg.

[73] Assignee: Cascade Corporation, Portland, Oreg.

[21] Appl. No.: 77,556

[22] Filed: Jun. 14, 1993

[51] Int. Cl.[5] ..... B66F 9/18

[52] U.S. Cl. ..... 414/621; 294/119.1; 414/667

[58] Field of Search ..... 414/607, 668, 621–623, 414/671, 667; 294/119.1

[56] References Cited

U.S. PATENT DOCUMENTS

| | | | |
|---|---|---|---|
| 1,518,561 | 12/1924 | Carroll | 414/621 |
| 2,746,630 | 5/1956 | Sinclair | 414/621 |
| 2,782,065 | 2/1957 | Lord | 414/621 X |
| 2,788,148 | 4/1957 | Parcell | 414/621 |
| 2,920,775 | 1/1960 | Schenkelberger | 414/621 |
| 3,104,023 | 9/1963 | Smith et al. | 414/621 |
| 3,819,078 | 6/1974 | Walsh | 414/671 |
| 3,971,585 | 7/1976 | LaBudde | 414/621 X |
| 4,185,944 | 1/1980 | Seaberg | 414/621 |
| 4,279,564 | 7/1981 | Weinert | 414/621 |
| 4,960,357 | 10/1990 | Laursen | 414/671 X |

FOREIGN PATENT DOCUMENTS

| | | | |
|---|---|---|---|
| 55874 | 7/1982 | European Pat. Off. . | |
| 2929712 | 2/1981 | Fed. Rep. of Germany . | |
| 51-74355 | 6/1976 | Japan . | |
| 51-129069 | 11/1976 | Japan . | |
| 57-56694 | 4/1982 | Japan . | |
| 1011496 | 4/1983 | U.S.S.R. | 414/671 |

OTHER PUBLICATIONS

Drawing of Kaup Clamp Slide Structure 1980.

*Primary Examiner*—David A. Bucci

*Attorney, Agent, or Firm*—Chernoff, Vilhauer, McClung & Stenzel

[57] ABSTRACT

A load-handling parallel arm clamp structure for a lift truck comprises a slide guide frame having respective upper and lower pairs of elongate, parallel, vertically-spaced transverse slide guides with load-arm supporting slide members longitudinally movable thereon alternatively toward or away from one another in a mutually overlapping longitudinal relationship. Each slide member at least partially surrounds the respective slide guide upon which it is mounted, and each slide guide in turn at least partially surrounds a respective piston and cylinder assembly for moving the slides relative to the guides. The upper and lower pairs of guides are separated by a wide, unobstructed central vertical space through which the operator can view in a forward direction, such space being unoccupied by any view-impeding piston and cylinder assemblies due to their placement inside the guides. A compact fluid manifold and valve arrangement for controlling the piston and cylinder assemblies, together with the space-saving cylinder-enclosing slide guides, minimize the thickness of the entire assembly in the forward direction to maximize load-carrying capacity compatibly with the high degree of operator visibility provided.

45 Claims, 11 Drawing Sheets

LIFT TRUCK PARALLEL ARM CLAMP FOR COMPATIBLY MAXIMIZING OPERATOR VISIBILITY AND LOAD-CARRYING CAPACITY

BACKGROUND OF THE INVENTION

This invention relates to improvements in lift truck load-handling attachments having parallel load-handling arms (i.e. clamp arms, laterally-movable forks or other load-engaging implements), mounted on transverse slide members for opening and closing and thereby forcibly engaging the sides of loads. Such load-handling arms typically exert relatively high inward lateral force on a load by closing forcibly against the opposite exterior sides thereof to engage and lift it. In some cases the arms may also exert lateral force in an outward direction by opening forcibly against interior opposed surfaces of a load.

Prior load-handling devices of this type, referred to hereafter generally as load "clamps," are exemplified by U.S. Pat. Nos. 2,746,630, 2,782,065, 4,185,944 and 4,279,564, and by clamps manufactured by Kaup & Co. GmbH of Germany. All such load clamps have had certain characteristics in common to enable them to function properly. First, the slide members, and the slide guides upon which the slide members are movably mounted, have always been capable of withstanding large load moments, particularly moments about vertical axes in reaction to the lateral clamping force and, in some cases, moments about longitudinal axes where the load arms are forks and the lateral clamping force is concentrated adjacent the lower extremity of the slide assembly. These large load moments have required an extremely strong and rigid guide and slide assembly, most commonly provided by respective upper and lower pairs of guides and slides. Moreover, because the range of load widths is extremely large, a correspondingly large range of extensibility and retractability of the slide members has been required to enable the load arms to accommodate the different load widths. This in turn has required that the elongate slide members, the slide guides upon which they are mounted, and the piston and cylinder assemblies which move the slide members, all be of significant length, with the slide members longitudinally movable alternatively toward or away from one another in a mutually-overlapping longitudinal relationship. Furthermore, the forward protrusion of the slide members must be minimized so that the load can be carried by a counterbalanced lift truck at the smallest possible forward distance from the truck's front axle, in order to maximize the load-carrying capacity of the counter-balanced truck.

Several of the foregoing requirements of load clamps differ significantly from those of fork-positioning devices which also mount on lift trucks and move the forks alternately toward or away from each other laterally, as shown for example in Japanese patent publications 57-56694, 51-74355, and 51-129069, Russian patent publication 1011-496, and German patent 2929712. None of these fork-positioners is required to impose a high lateral clamping force on a load, nor to provide the range of extensibility and retractability required of a load clamp. Rather, such fork positioners normally move the forks laterally only when the forks are unloaded, so as to position them properly for engaging the bottom of a load, requiring little force and no resistance to the load moments mentioned previously. Moreover, the range of lateral fork positioning movements is relatively small compared to that of a load clamp, eliminating the need for long guides and piston and cylinder assemblies, as well as slide members which move toward or away from each other in a mutually-overlapping longitudinal relationship.

Both load clamps and fork positioners share a common need for enabling the lift truck operator to see the tips of the lower portions of the load-handling arms at varying elevations of the load-handling device, so that the operator can properly position the arms for engagement of a load. The primary visibility needs occur when the lower portions of the load-handling arms are at approximately 1450 millimeters above the ground (highway trailer height), at 1200 millimeters height (the normal interface between the upper and lower portions of a two-tiered load), and at ground level. However, because the foregoing two elevated positions require visibility through the vertical midsection of the load-handling device, it has been virtually impossible to effectively satisfy such visibility needs where load clamps are concerned because of the large slide, slide guide and piston and cylinder assemblies which must be provided to satisfy the high strength and range of motion requirements of load clamps. Space constraints have always required that the vertical midsections of such clamps be occupied by opposed piston and cylinder assemblies and/or other slide structure. Usually, a collection of separate hydraulic conduits (two per piston and cylinder assembly) also occupy the vertical midsection area. It has not been possible to create the extra space in a load clamp necessary to provide a vertical midsection free of obstruction without increasing the vertical height of the clamp to the point where the operator cannot see over the top of the clamp to the tips of the lower portions of the load arms when the clamp is lowered to the ground.

The foregoing visibility problem is not so severe where fork positioners are concerned, because the reduced loading and range of lateral motion of a fork positioner do not require that the slides and piston and cylinder assemblies be particularly large or vertically offset from each other in longitudinally-overlapping relationship, as is required with a load clamp. Accordingly it is much easier to create an unobstructed vertical midsection in a fork positioner than in a load clamp.

Another type of forklift truck load-handling device which has laterally openable and closable load-handling arms is a container handler such as that shown in European patent publication 055874. However such a device engages the load from its top rather than on its sides, so that the slides, guides and piston and cylinder assemblies are arranged in a horizontal plane instead of a vertical plane as in a load clamp. Accordingly such a device does not have visibility needs, or strength and protrusion requirements for the slides and guides, comparable to those of a load clamp.

SUMMARY OF THE INVENTION

The present invention provides a load clamp having a vertical midsection which is unobstructed by slides, guides or piston and cylinder assemblies, thereby permitting the operator to view the tips of the lower portions of the load-handling arms through the midsection of the clamp at the elevations described above. Nevertheless, the overall height of the clamp is minimized to enable the operator also to see the load arm tips over the top of the clamp when the clamp is in a fully-lowered position. The foregoing objectives are accomplished in a manner which compatibly minimizes the forward protrusion of the slide and guide assembly of the clamp in order to minimize the protrusion of the load forwardly of the lift truck's front axle, so as to maximize the load-carrying capacity of a counterbalanced lift truck.

The foregoing objectives are accomplished by providing extremely compact upper and lower pairs of slide guides, with respective piston and cylinder assemblies mounted inside at least one pair of the guides.

Preferably, in order to maximize compactness, slide strength and viewability through the midsection of the clamp, the slides at least partially surround their respective slide guides.

The fact that the piston and cylinder assemblies must be of substantial length to provide the necessary range of load arm motion, and are at least partially surrounded by their respective guides, creates difficulties with regard to the supply and exhaust of pressurized fluid to the respective ends of each cylinder. However, this problem is resolved by the provision of fluid conduits within each slide guide extending longitudinally thereof exterior of the respective piston and cylinder assembly located inside the guide. Preferably a compact fluid manifold vertically interconnects the slide guides, providing operative interconnections between the fluid conduits inside the guides and eliminating the need for separate external hydraulic conduits which would impede visibility.

Because the piston and cylinder assemblies are substantially immovably mounted within the confines of the respective slide guides, a unique interconnection between each piston and cylinder assembly and its respective slide member is provided to permit relative movement therebetween, preferably both to accommodate relative pivoting movement due to the various load moments, and to permit relative vertical movement due to load weight and guide bushing wear.

Valving for the respective piston and cylinder assemblies is compactly provided in a location vertically between the upper and lower pairs of slide guides and off-center relative to the length of the slide guides, so as not to interfere with viewability through the vertical midsection of the clamp.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENT

Figure 1A:
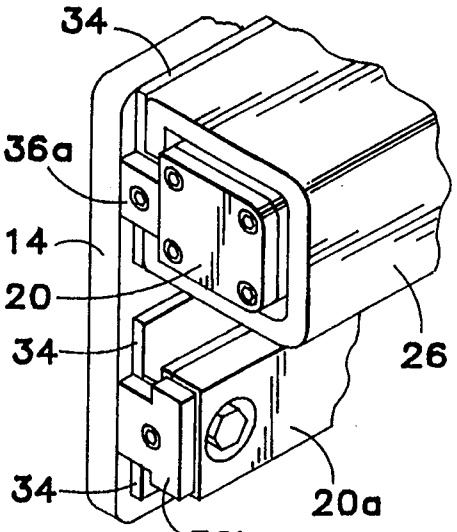
FIG. 1A is an enlarged perspective view of a portion of the clamp of FIG. 1.
Figure 1:
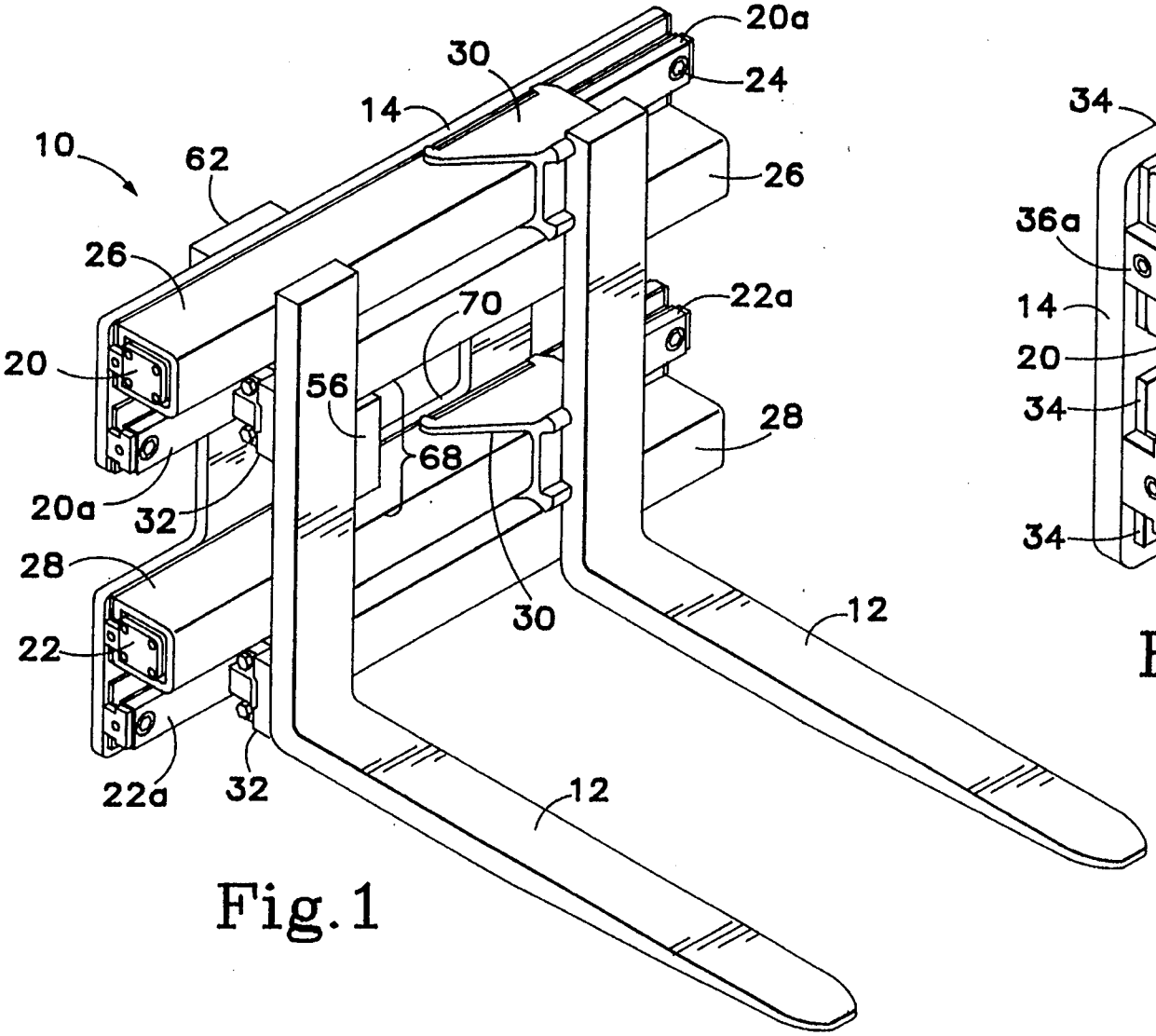
FIG. 1 is a perspective view of an exemplary embodiment of the load clamp of the present invention shown with fork-type load-handling arms.
Figure 2:
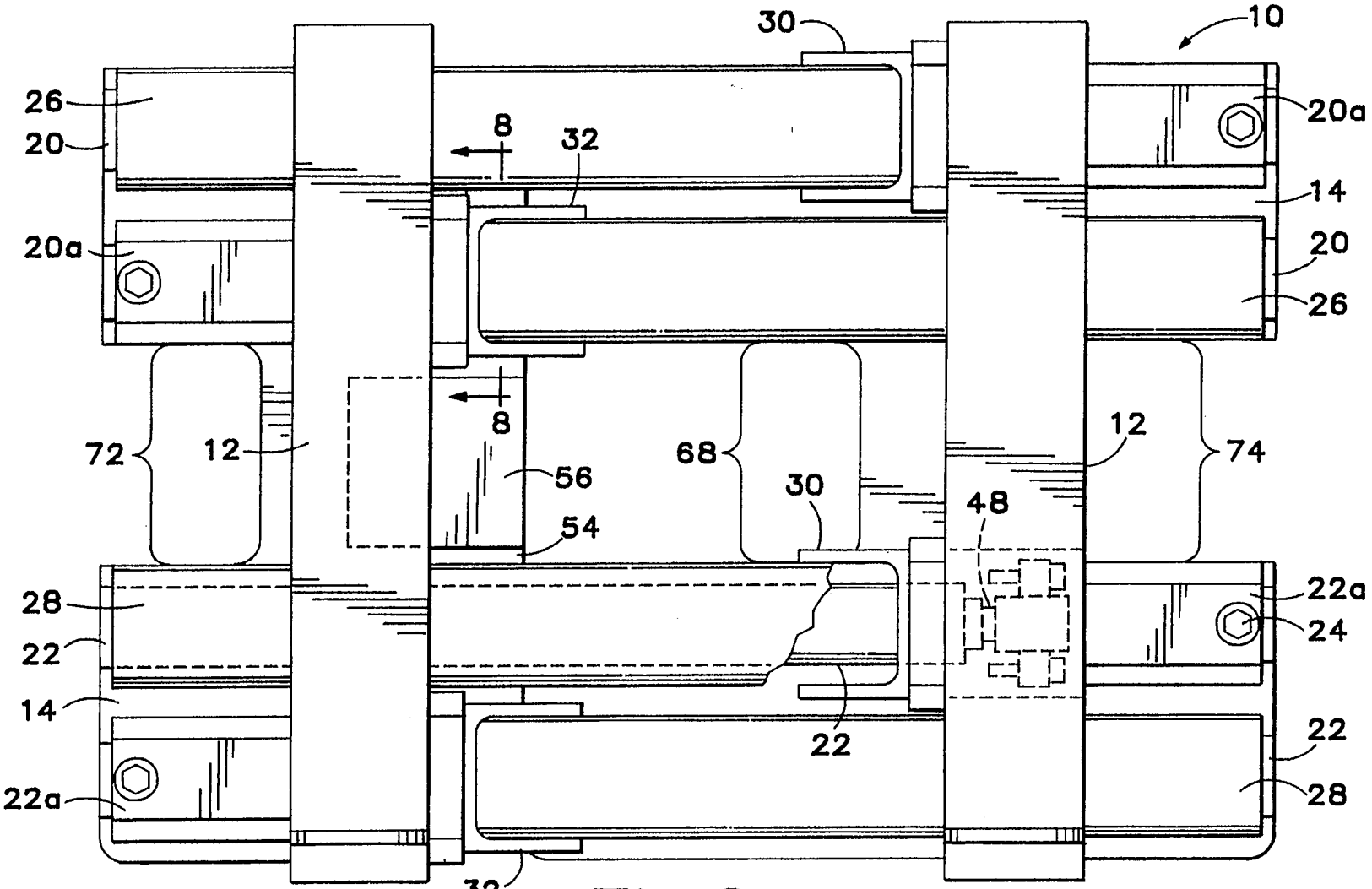
FIG. 2 is a front view of the clamp of FIG. 1, with one of the slides broken away to show underlying structure.

The embodiment of the lift truck clamp 10 shown in FIGS. 1–11 employs fork-type load-handling arms 12 capable not only of insertion underneath the bottom of a load, but also capable of engaging the opposite exterior or interior side surfaces of a load by imposing lateral clamping force thereon to lift the load. A slide guide frame 14, adapted to be mounted vertically on the load carriage of a lift truck by means of upper and lower carriage hooks 16 and 18 (FIGS. 3 and 4), is provided with a respective upper pair of transverse slide guides 20 and a lower pair of transverse slide guides 22 mounted on the frame by means of bolts such as 24. Respective pairs of slide members 26 and 28 are longitudinally movably mounted on each of the upper and lower pairs of slide guides 20, 22, each pair of slide members being longitudinally movable alternatively toward or away from one another in a mutually-overlapping longitudinal relationship as shown, for example, in FIGS. 1 and 2. One of the load-handling arms 12 is mounted to the upper slide 26, 28 of each pair of slides by respective mounting fixtures 30, while the other load arm 12 is mounted to the lower slide 26, 28 of each pair of slides by respective mounting fixtures 32. The slide members to which a respective arm 12 is not mounted are permitted to pass freely transversely behind the respective arm 12, so that the longitudinal movable overlapping of the respective pairs of slide members enables the arms 12 to be brought together to closed positions within the lateral extremities of the frame 14 as shown in FIG. 1 in order to clamp a narrow load, and to be spread apart to widely-spaced, fully-opened positions exterior of the frame's lateral extremities in order to clamp a wide load.

Figure 3:
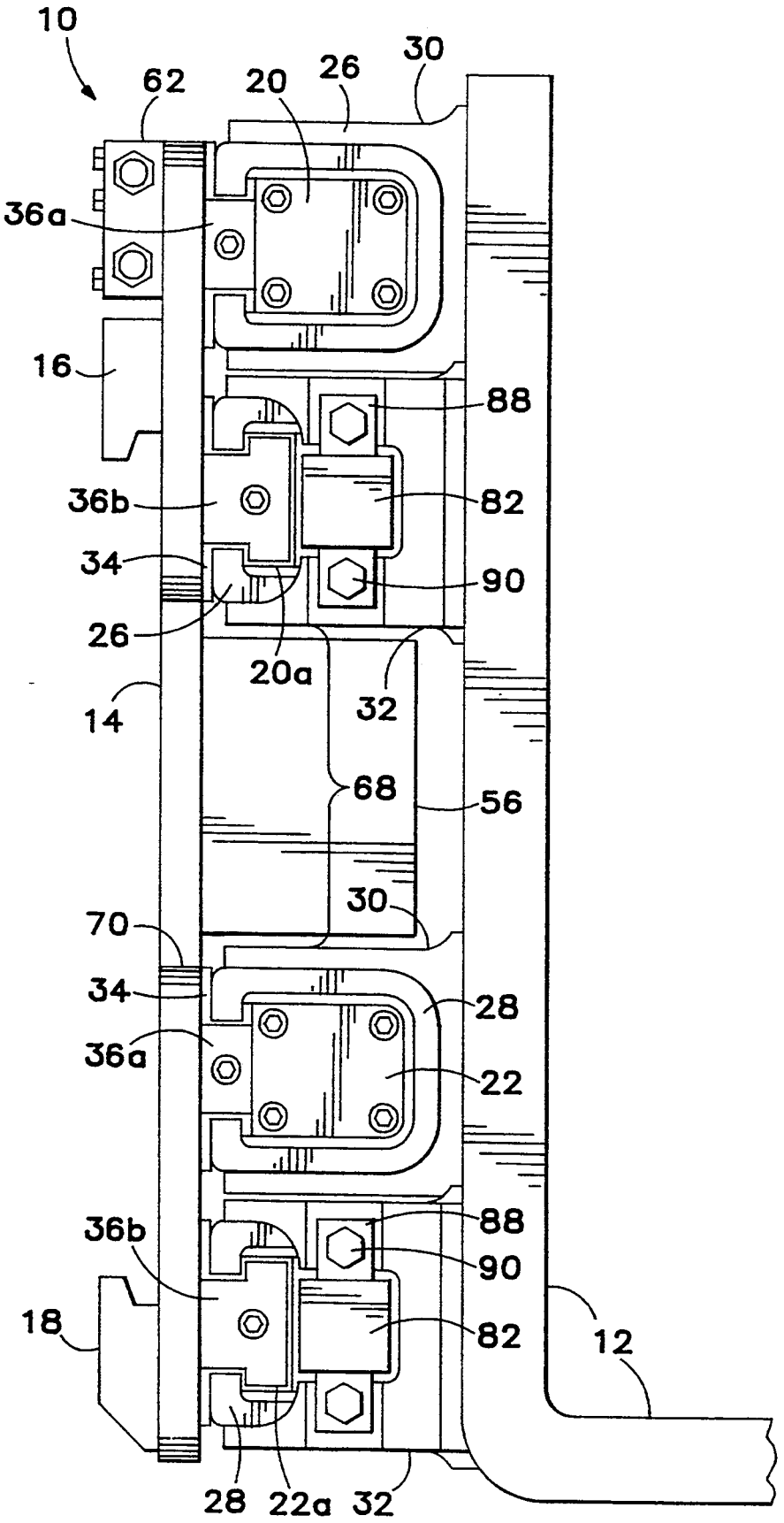
FIG. 3 is a side view of the clamp of FIG. 1.
Figure 8:
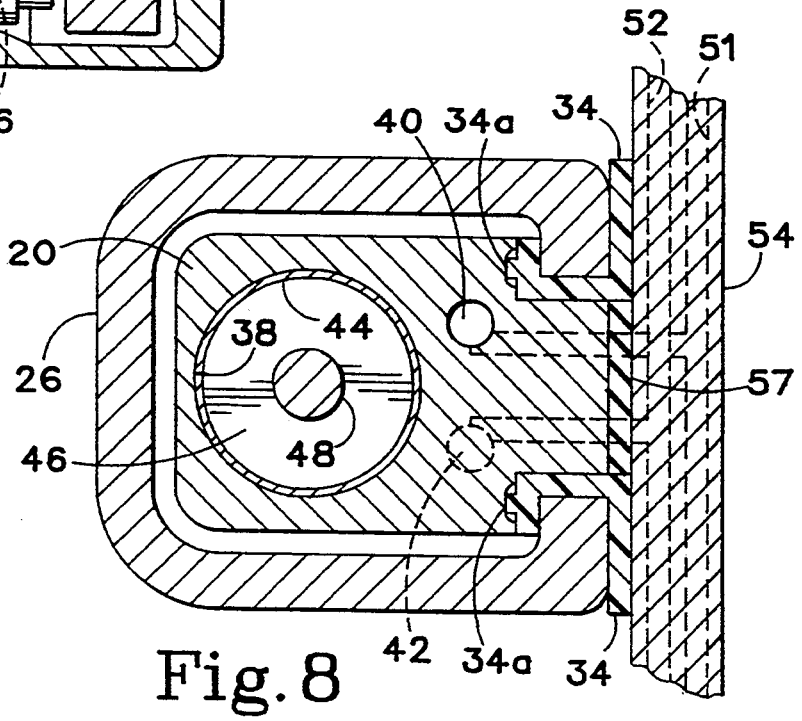
FIG. 8 is a sectional view of one of the slide guides and slides, taken along line 8—8 of FIG. 2.

Preferably, to achieve the most compact slide and guide arrangement in both the vertical direction and the forward direction in a manner compatible with maximum slide member strength, so as to maximize visibility through the midsection of the clamp as described hereafter while also maximizing the counterbalanced load-carrying capacity of the lift truck, the slide members 26 and 28 at least partially surround the respective slide guides 20, 22 upon which they are mounted. Each slide member has a generally C-shaped cross section surrounding a generally T-shaped guide cross section as best shown in FIGS. 3 and 8. Elongate U-shaped plastic slide bushings 34 provide a wear-resistant, low-friction interface between the slide members and the slide guides. Retainer caps **36*a* and 36*b* on the ends of the guides prevent the bushings 34 from sliding longitudinally off the guides, but permit easy replacement of the bushings 34 when the caps are removed. As shown in FIG. 8, each bushing 34 has a longitudinal ridge portion 34***a* which fits in a mating longitudinal groove in the respective slide guide so that, when the slides are in a relatively extended position relative to the slide guides, the portions of the bushings 34 not contacted by the slide members will not inadvertently lift out of their slide guide channels.

Figure 4:
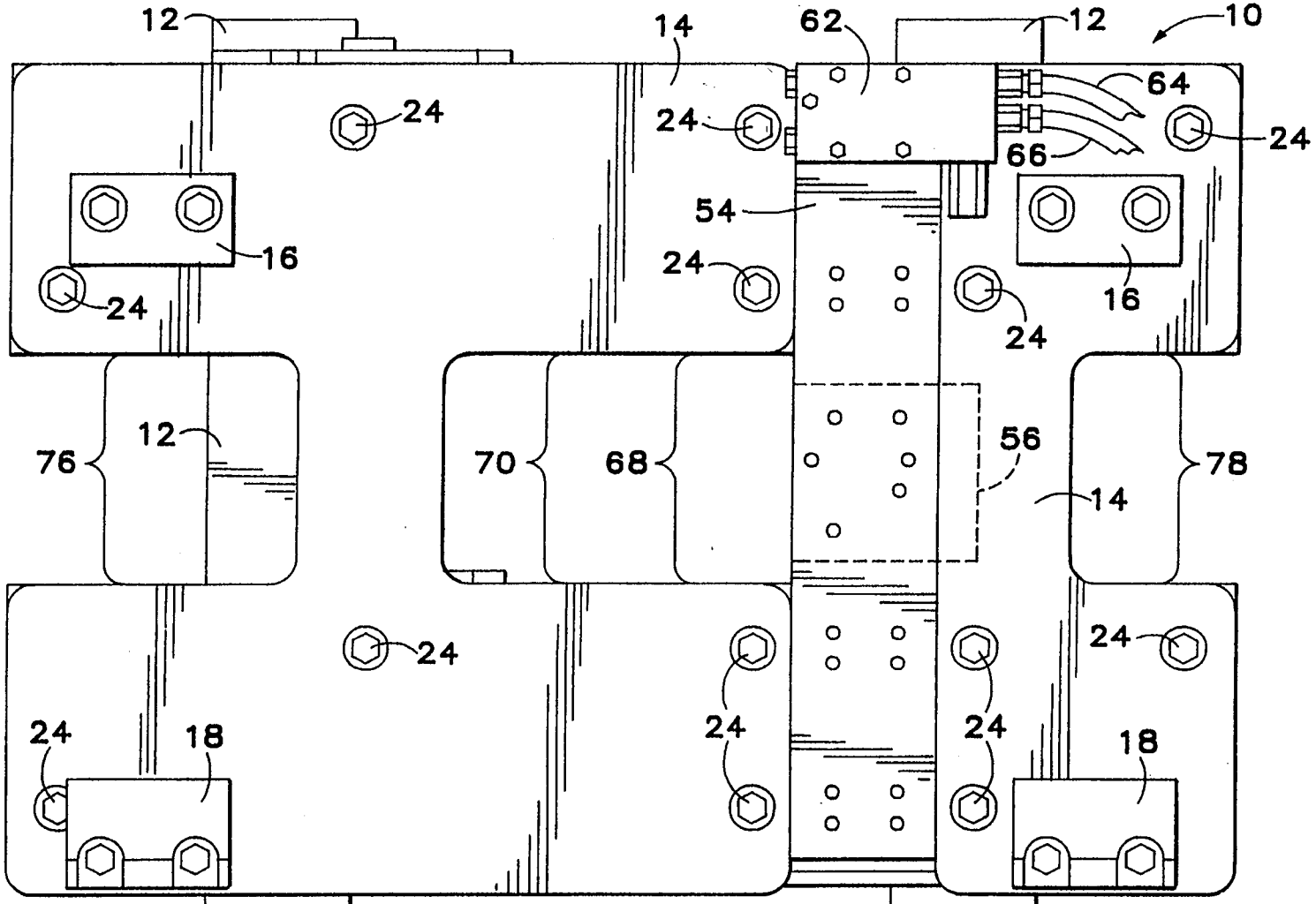
FIG. 4 is a rear view of the clamp of FIG. 1.
Figure 5:
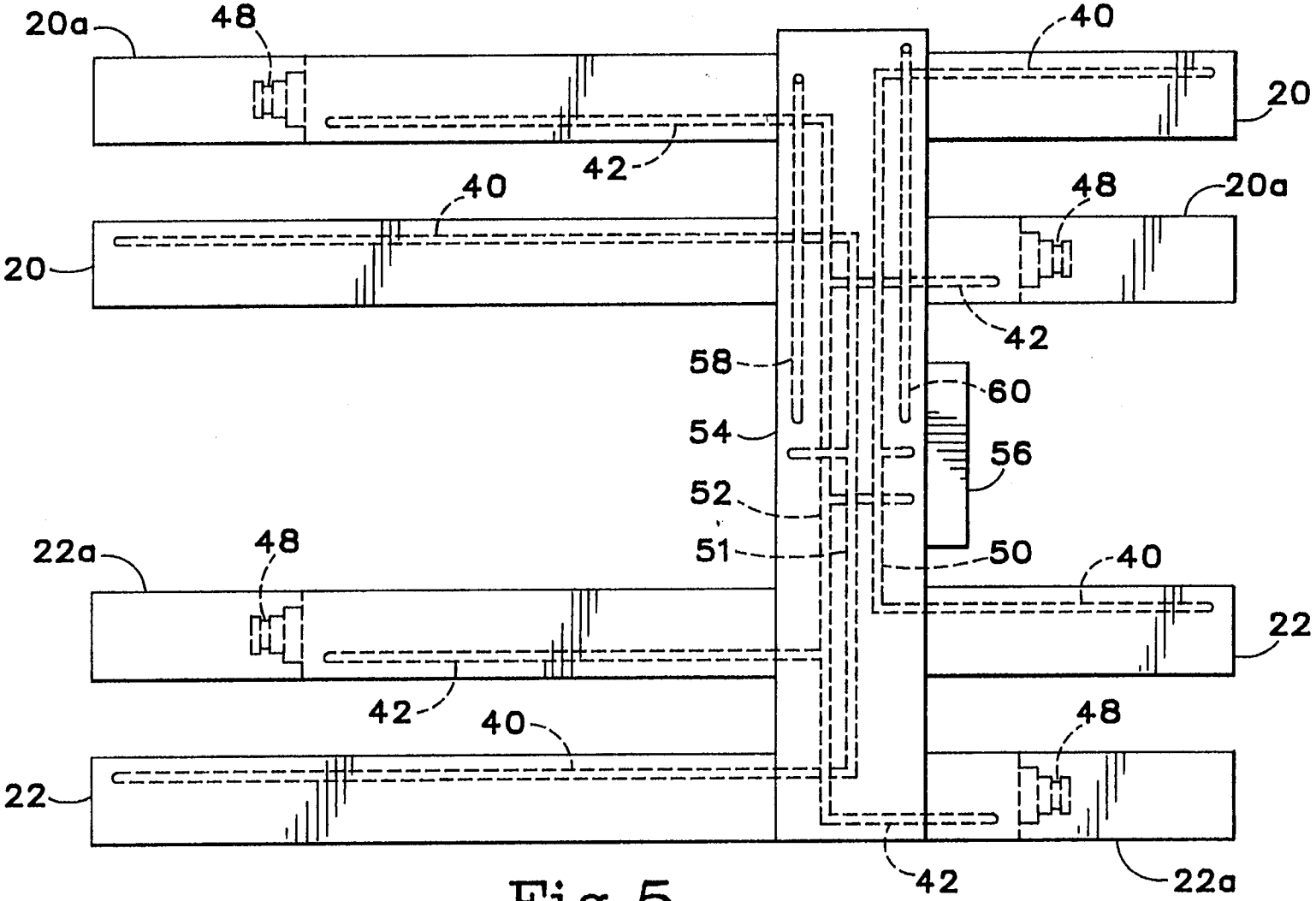
FIG. 5 is a partially schematic rear view of the slides and fluid manifold portion of the clamp of FIG. 1, showing the fluid circuitry.

At least one of the upper and lower pairs, and preferably both pairs, of the slide guides have a respective piston and cylinder assembly mounted within each guide. For fork-type load-handling arms such as those shown in FIG. 1, it may be adequate if such piston and cylinder assemblies are mounted only within the lower pair of guides 22 near the points of application of the lateral force. For other types of load handling arms such as opposed plate-like carton clamp or bale clamp arms, a respective piston and cylinder assembly should be located within each of the upper and lower pairs of slide guides to distribute the clamping force substantially uniformly in the vertical direction while minimizing the cylinder diameters necessary to provide the necessary clamping force, which in turn advantageously minimizes both the vertical and forward dimensions of the slide guides. As shown in FIG. 8 with respect to one of the upper slide guides 20, each slide guide having a piston and cylinder assembly located therein is preferably extruded so as to include an integral circular bore 38 longitudinally therethrough, together with a pair of longitudinal integral fluid conduits 40, 42. Each circular bore 38 is detachably lined with a removable cylindrical steel tube 44 and sealingly capped at each end to form an enclosed cylinder. The tube 44 is easily replaceable if it becomes scored or otherwise damaged. Inside each cylinder is a piston 46 which drives a piston rod 48 to extend or retract in response to pressurized fluid introduced into one end of the cylinder through conduit 40 (for extension) or into the other end of the cylinder through conduit 42 (for retraction). Pressurized extension fluid is supplied to each conduit 40 through a respective feeder conduit 50 or 51 of a fluid manifold 54 (FIGS. 5 and 8). Retracting fluid, on the other hand, is fed to each of the conduits 42 through a con, non feeder conduit 52 extending through the same manifold. The manifold 54 extends vertically between all of the slide guides having piston and cylinder assemblies therein, and is bolted tightly to the rear surface of each slide guide so as to interface its respective feeder conduits 50, 51 and 52 through a fluid seal 57 (FIG. 8) with the respective fluid conduits 40 and 42 inside each slide guide. Feeder conduits 50, 51 and 52 receive their fluid from a valve assembly 56 mounted on the front of the manifold 54, which in turn receives fluid through manifold conduits 58 and 60 from a junction block 62 (FIG. 4) on the rear of the manifold connected through hydraulic hoses 64, 66 to the hydraulic system of the lift truck. The junction block 62 has hose connectors on both sides as shown in FIG. 4 to accommodate the hoses 64, 66 regardless of their direction of approach from the lift truck. The valve assembly 56 likewise has hose connectors which offer connecting versatility to accommodate different lift trucks.

To ensure that the manifold 54 does not add any forward protrusion to the clamp assembly, which would otherwise push the load forwardly and thereby reduce the counterbalanced lifting capacity of the lift truck, the manifold 54 extends rearwardly to substantially no greater extent than does the slide guide frame 14. With reference to FIG. 4, this feature is achieved by dividing the frame 14 into two transversely-spaced-apart frame sections interconnected through the slide guides by the bolts 24, with the manifold 54 being inserted transversely between the two frame sections and having a thickness no greater than that of the frame 14. Likewise, to ensure that the valve assembly 56 does not add to the forward protrusion of the clamp assembly, the valve assembly is mounted vertically between the upper and lower pairs of slide guides in a forwardly-overlapping relationship thereto, but extending forwardly to no greater extent than the slide members.

The manifold 54 and valve assembly 56 are located significantly off-center relative to the length of the slide guides to create an unobstructed, centrally-located vertical viewing space 68 extending substantially completely between the upper and lower pairs of slide guides and their associated slide members. Such viewing space 68 corresponds to the location of a viewing aperture 70 formed in the frame 14 so that the operator may see forwardly through the central midsection of the clamp assembly. The viewing space 68 has slightly narrowed upper and lower boundaries when the load-handing arms are in a relatively closed position as shown, for example, in FIG. 1 due to the thickness of the slide members 26 and 28 impinging upon the viewing space. However, when the load-handling arms are spread, the slide members slide transversely out of the viewing space and thereby enlarge its upper and lower boundaries, which is an additional advantage from a visibility point of view of utilizing slide members which surround their respective slide guides, rather than slide members which are interior of the slide guides. Additional viewing spaces 72 and 74 (FIG. 2), corresponding to apertures 76 and 78 in the frame 14 (FIG. 4), are also provided between the upper and lower pairs of slide guides in transversely outward locations on the clamp assembly.

Figure 6:
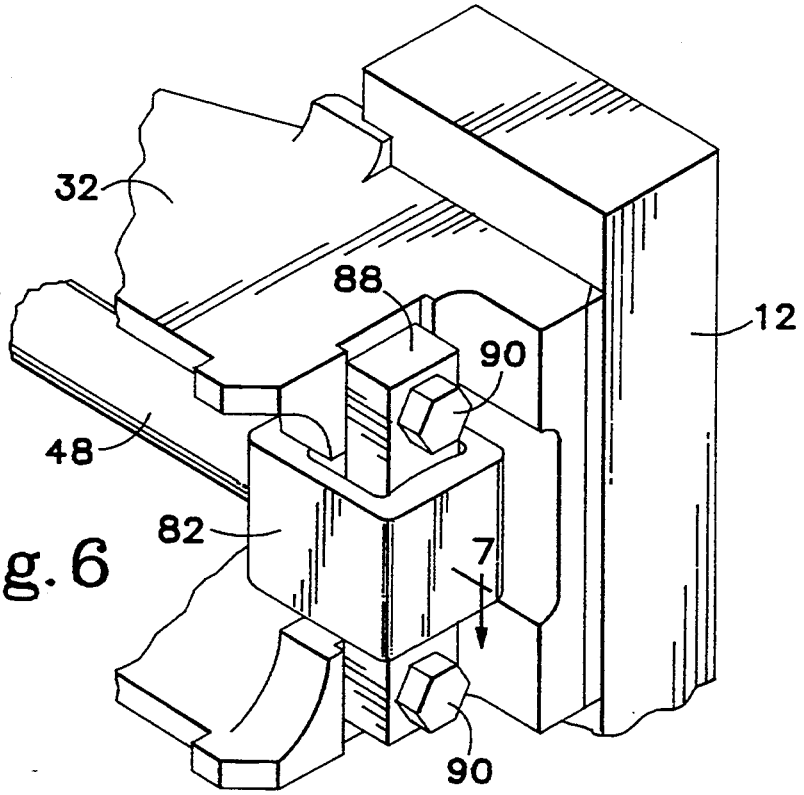
FIG. 6 is an enlarged perspective view of a movable interconnection between a piston and cylinder assembly and one of the slides of the clamp of FIG. 1.
Figure 7:
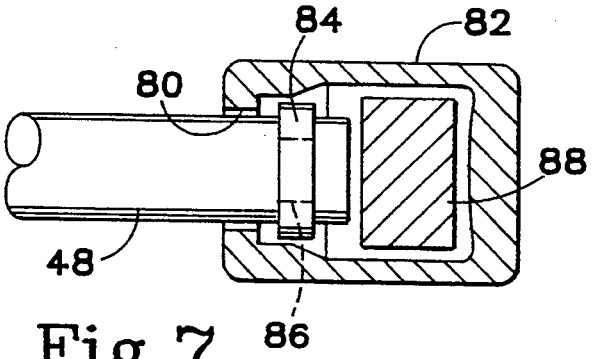
FIG. 7 is a partially sectional view taken along line 7—7 of FIG. 6.

The connection of each piston rod 48 to a respective slide guide through a respective mounting fixture 30 or 32 is shown in FIGS. 6 and 7 with respect to one of the mounting fixtures 32. Because the piston and cylinder assemblies are advantageously mounted within the confines of the respective slide guides so that they do not occupy and obstruct the central viewing space 68, they are substantially immovable within the slide guides, especially so when they are housed in integral circular bores within the guides as depicted in the preferred embodiment. Due to their immovability within the guides, the longitudinal axes of the respective piston rods 48 are substantially fixed, and unable to tilt to any significant degree in any direction relative to the guides. In contrast, the respective slide members to which the rods 48 are attached by means of the mounting fixtures 30, 32 are subjected to large load moments about different axes as described earlier, which tend to cause them to tilt in different directions as clamping forces and load weight forces are applied, such tilting becoming more pronounced as the slide bushings 34 wear. Moreover, the slide members lower vertically with slide bushing wear. Accordingly, it is necessary to provide means for accommodating relative movement between the end of each piston rod 48 and the respective slide member to which it is attached. This is accomplished by providing each mounting fixture 30, 32 with a movable interconnection with the respective piston rod 48. As shown in FIG. 7, the end of each piston rod 48 extends through an aperture 80 into a rectangular housing 82 where it is retained by a pair of split rings such as 84 seated in an annular groove 86 so that the rod 48 cannot be withdrawn from the housing 82. With the rod so retained, a bar 88 is loosely inserted through the housing 82 and fastened to the mounting fixture 32 by bolts 90. The relatively loose interface between the bar 88 and the rectangular housing 82 enables a relative pivoting movement between the end of the rod 48 and the slide member about vertical, forward horizontal and transverse horizontal axes, as well as permitting vertical movement between the slide member and rod.

As shown in FIG. 5, each piston and cylinder assembly, when in its fully-retracted position, does not extend the entire length of the slide guide within which it is mounted. This leaves an end portion 20*a* or 22*a*, as the case may be, projecting beyond the fully-retracted length of the piston and cylinder assembly. As is evident from FIG. 3, these end portions 20*a*, 22*a* have T-shaped cross sections of smaller cross-sectional area than those of the portions of the slide guides which enclose the respective piston and cylinder assemblies. This permits the mounting fixtures 30, 32, with their piston rod interconnection structures, to be retracted inwardly of the end portions 20*a*, 22*a* to obtain maximum closure of the load-handling arms to the positions shown 25 in FIG. 1.

Figure 9:
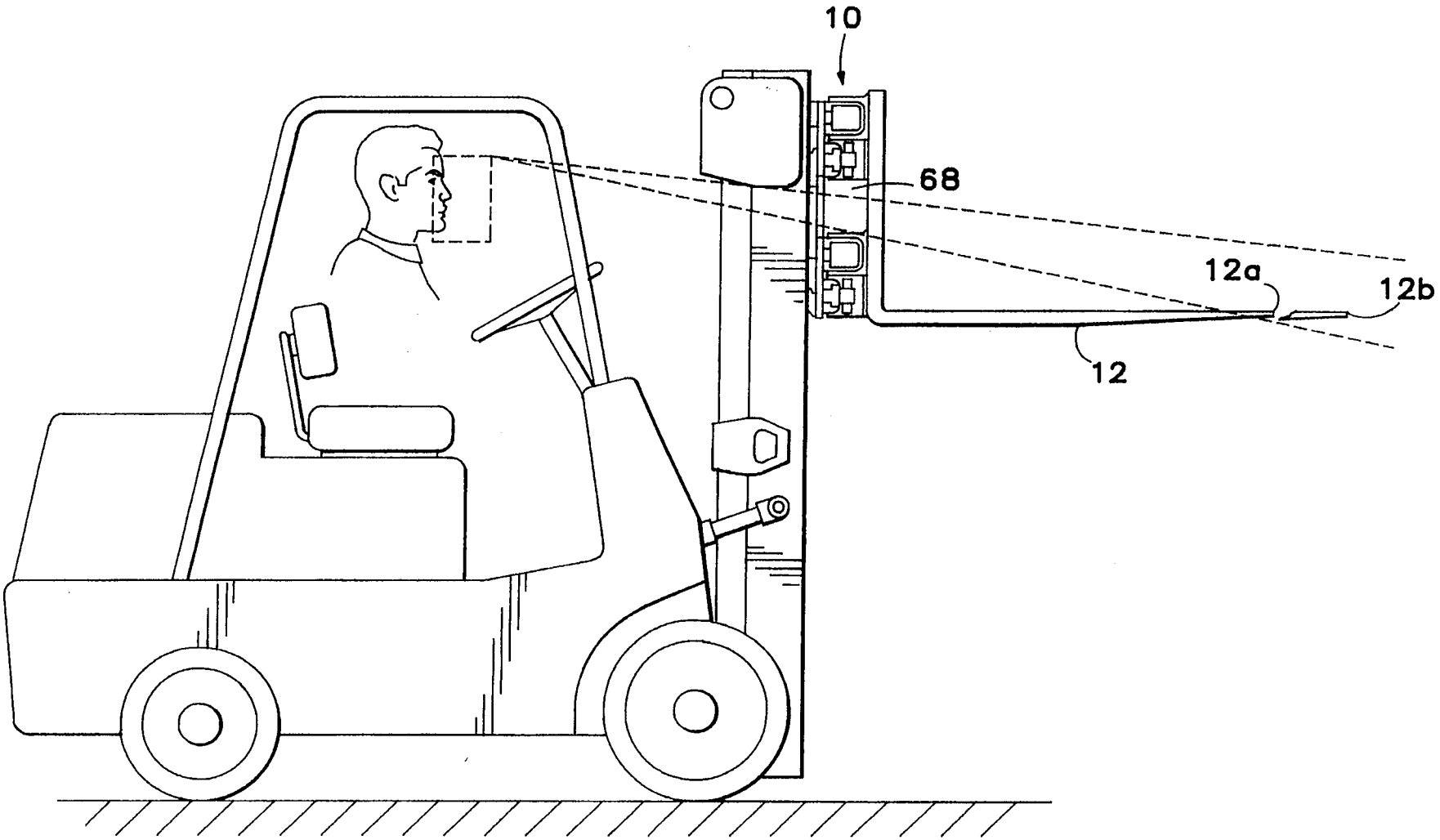
FIG. 9 is a side view of the clamp of FIG. 1 mounted on a lift truck and showing the operator's visibility through the clamp at an elevated position thereof.
Figure 10:
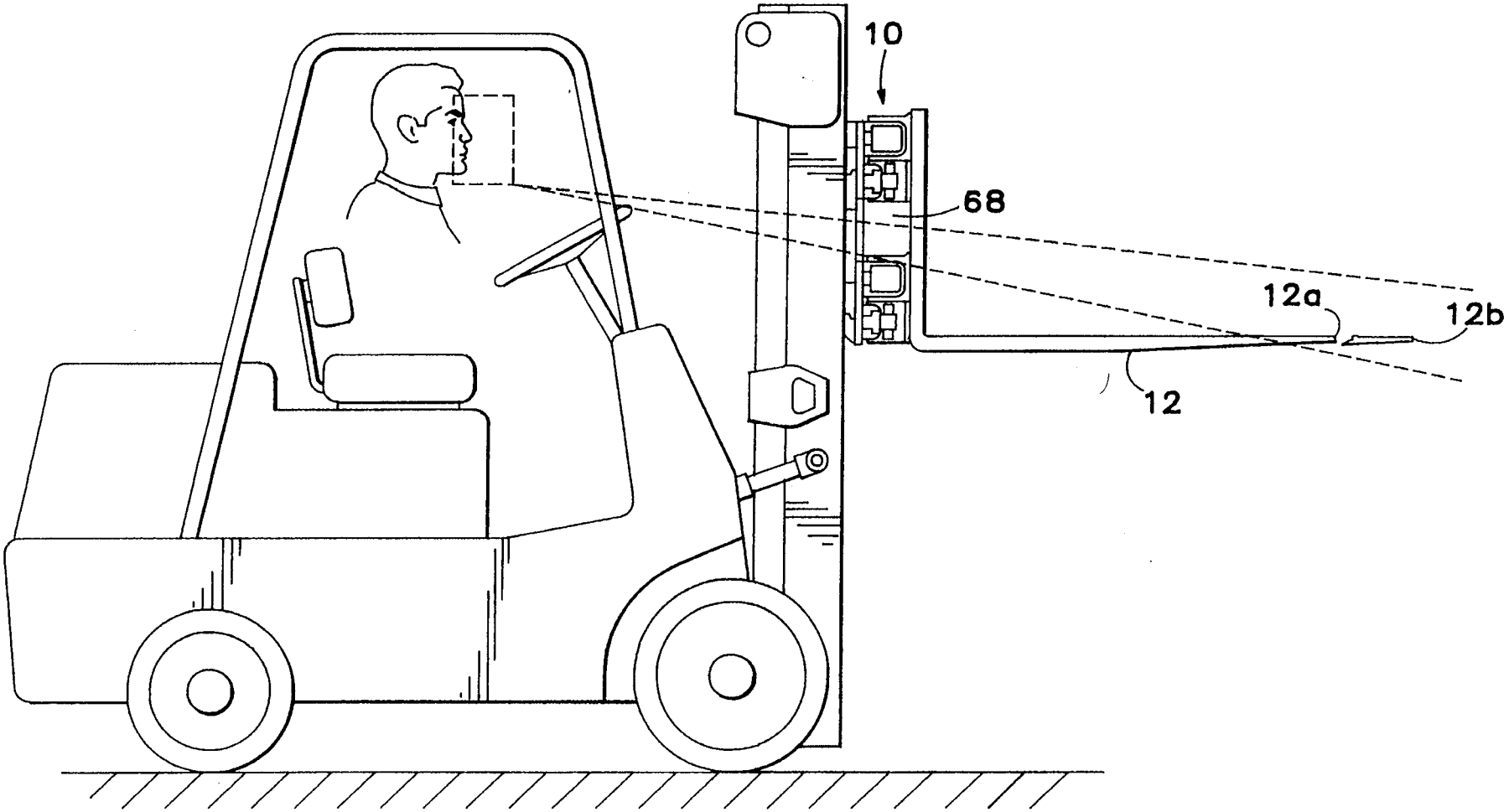
FIG. 10 is a side view similar to that of FIG. 9 showing operator visibility at a lower elevation of the clamp.
Figure 11:
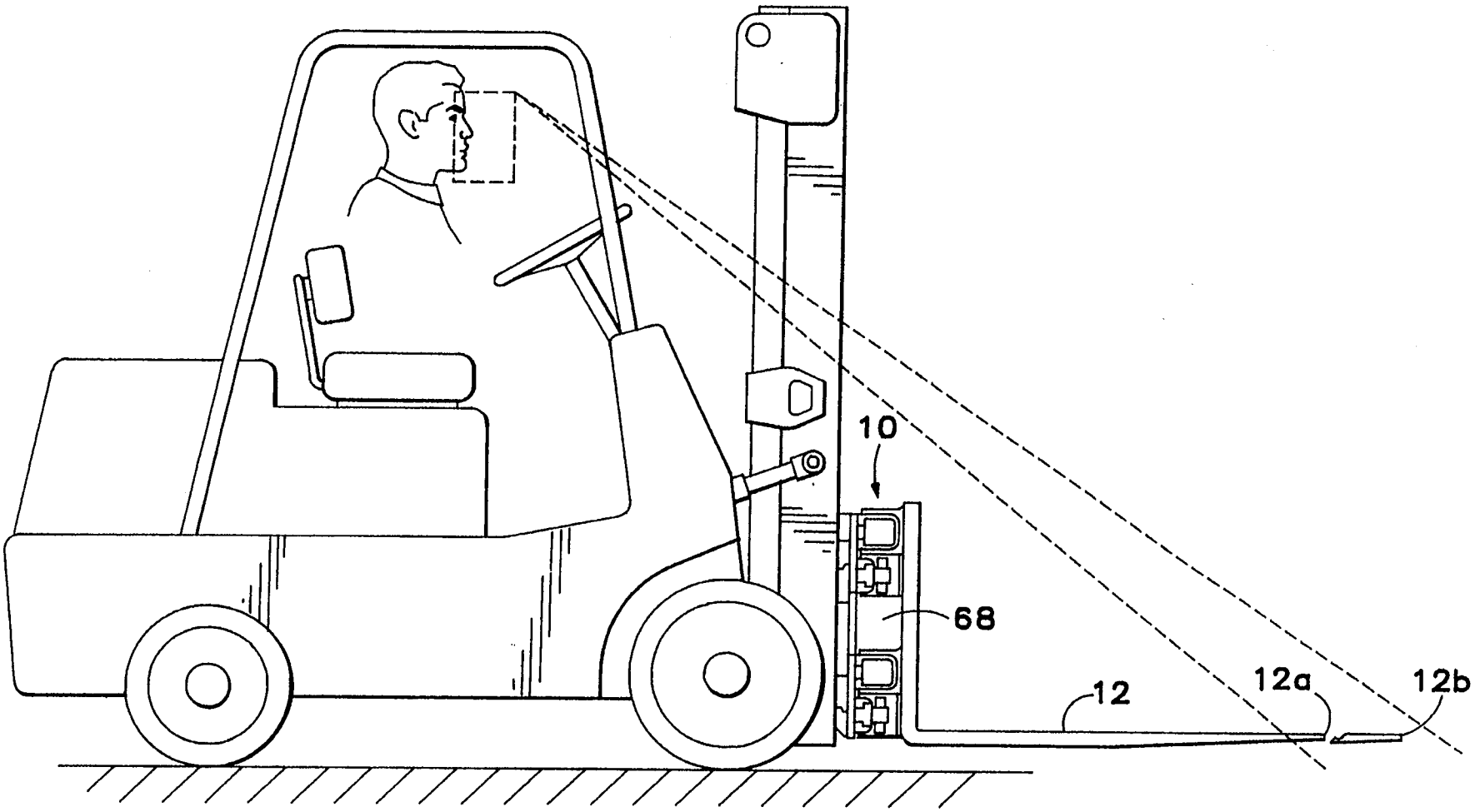
FIG. 11 is a side view of the clamp of FIG. 1 mounted on a lift truck and showing operator visibility with the clamp in a lowered position.

FIGS. 9–11 depict the visibility advantages of the viewing space 68 between the upper and lower pairs of slide guides. At a fork height of 1450 millimeters as shown in FIG. 9, which is the normal height of a highway trailer bed, the lift truck operator is able to view either the tip 12*a* of a 1000 millimeter length fork, or the tip 12*b* of a 1200 millimeter length fork, so as to properly position the forks for engagement relative to a load supported on such a trailer. Alternatively, as shown in FIG. 10, the operator by lowering his head slightly is able to view the same fork tips through the space 68 at a 1200 millimeter fork height, which is typical of the height of the interface between the upper and lower portions of a two-tier load stack. And, as shown in FIG. 11, the operator is likewise able to view the fork tips with the forks substantially completely lowered, because the provision of the viewing space 68 has not increased the height of the clamp 10 to a point which would obstruct the operator's view over the top of the clamp in the lowered position.

Figure 12:
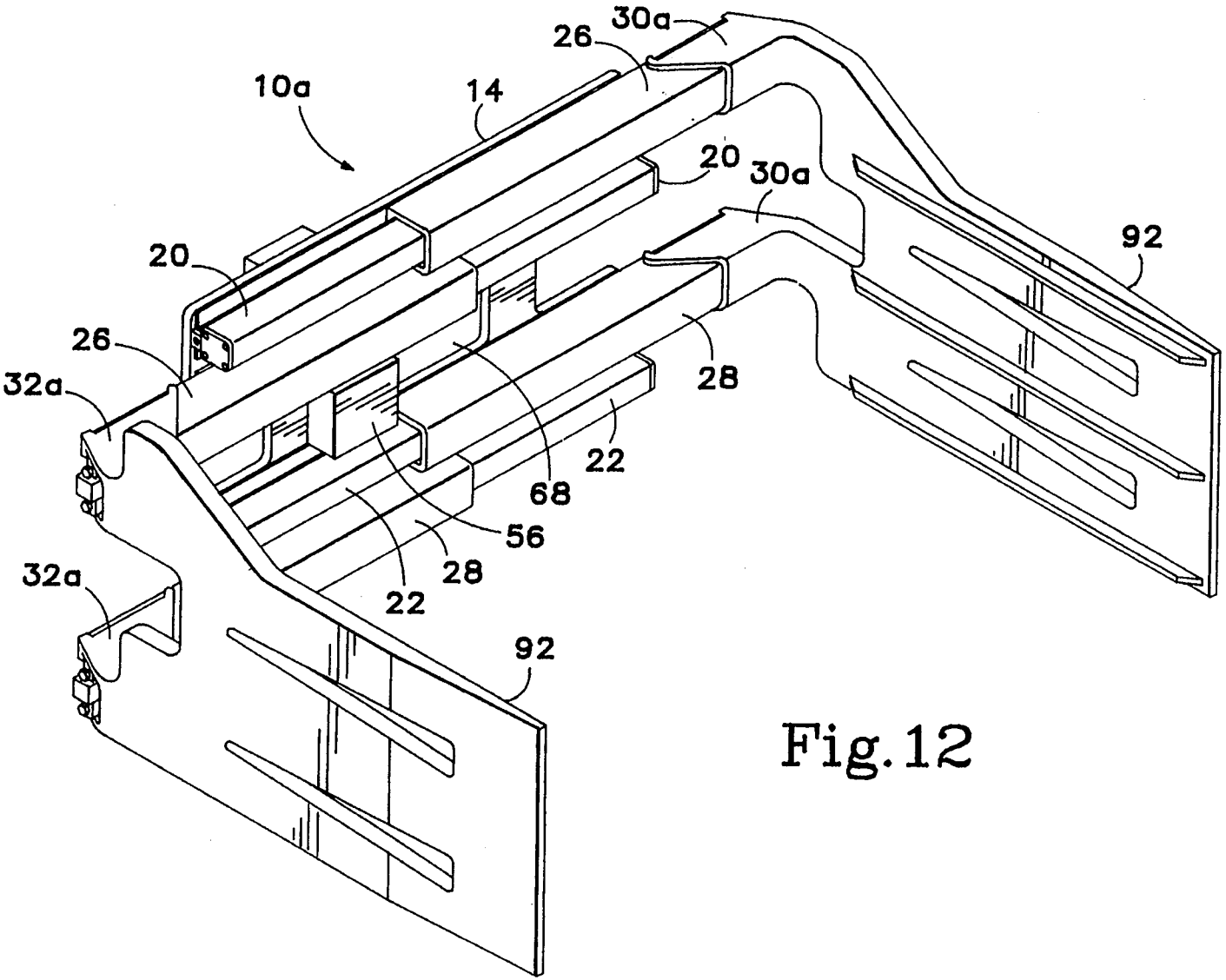
FIG. 12 is a perspective view of another exemplary embodiment of the load clamp, showing a different type of load-handling arm.

FIG. 12 depicts another embodiment 10*a* of the load clamp of the present invention, which is in all respects identical to that of the embodiment of FIGS. 1–11 except that the load arms 92 are bale clamp arms, and are connected to the respective slide members 26, 28 by mounting fixtures 30*a*, 32*a* respectively which are more integral with the clamp arms. Other types of load-handling arms may also be mounted on the clamp assembly.

Figure 13:
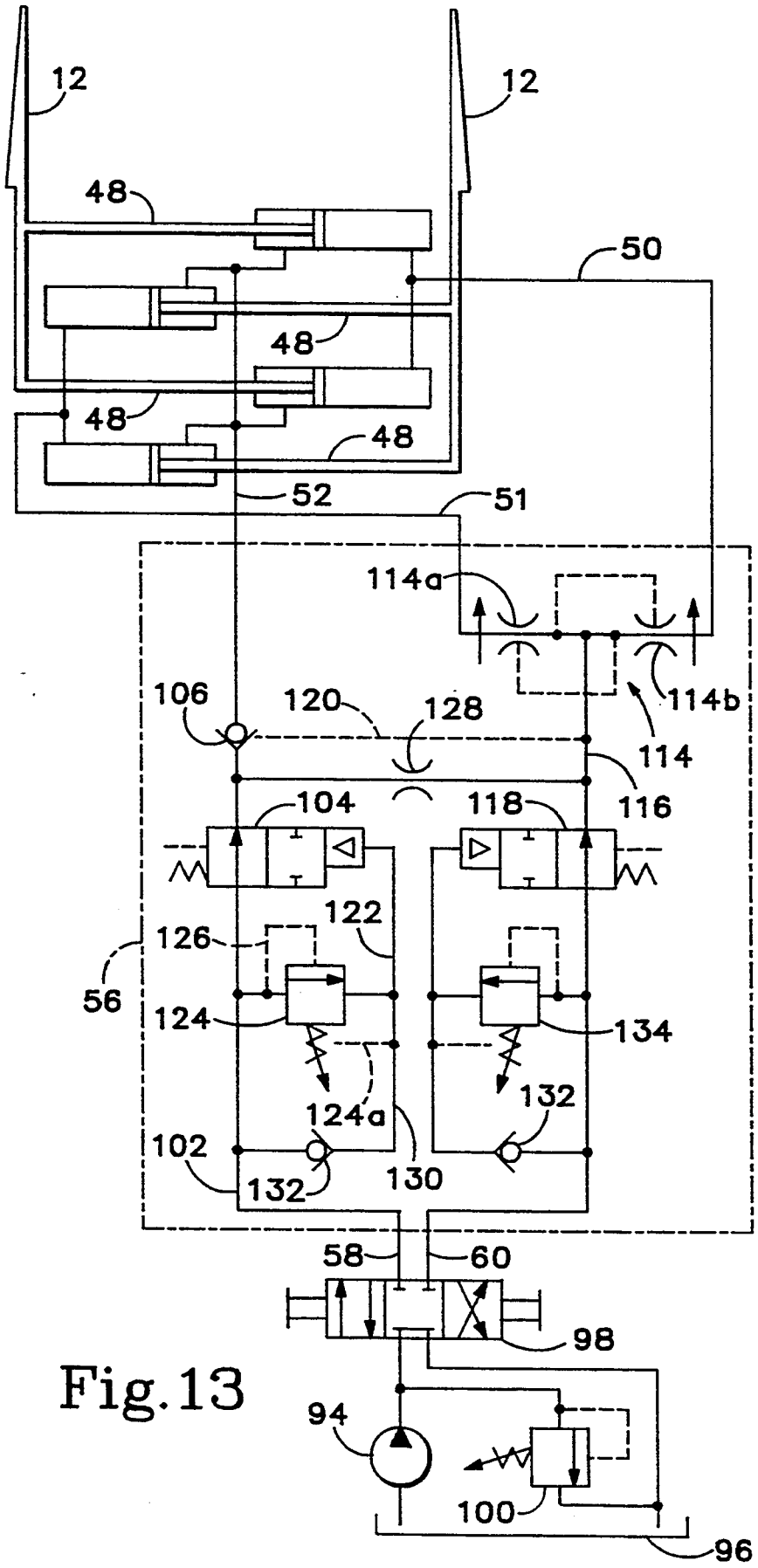
FIG. 13 is an exemplary hydraulic circuit diagram for the clamp of FIG. 1.

FIG. 13 shows schematically an exemplary hydraulic system for the clamp 10 or 10*a*. A lift truck hydraulic pump 94 draws fluid from a reservoir 96 and feeds it to a three-position operator control valve 98. Excess pump pressure is relieved through a conventional relief valve 100 mounted on the lift truck. Manifold conduits 58 and 60 (which are connected to the control valve 98 through hoses 64 and 66 and junction block 62 as discussed previously) interconnect the valve assembly 56 with the control valve 98. Manifold conduits 50, 51 and 52, in turn, connect the piston and cylinder assemblies with the valve assembly 56.

When the spool of the control valve 98 is moved to the right as shown in FIG. 13, pressurized fluid from the pump 94 is introduced into internal valve assembly conduit 102 which conducts the pressurized supply of fluid through normally open valve 104 and check valve 106 to manifold conduit 52. Conduit 52 distributes the fluid among the four piston and cylinder assemblies to retract them simultaneously, causing the load-handling arms 12 to close toward one another and exert lateral clamping force on the opposite exterior sides of a load. As the piston and cylinder assemblies are retracted by the fluid in conduit 52, fluid is simultaneously exhausted from the piston and cylinder assemblies through conduits 50 and 51, respectively. The fluid exhausted through conduits 50 and 51 passes through a flow divider/combiner 114 having variable pressure-controlled orifices 114*a* and 114*b* which automatically equalize the volumetric flow rates in the two conduits 50 and 51 to ensure that the two load-handling arms 12 move toward each other at the same speed. The combined exhausted fluid passes through a valve assembly internal conduit 116, through a normally open valve 118 and through the valve 98 from which it is emptied into the reservoir 96.

Conversely, to open the load-handling arms 12 either to release a load or to forcibly engage the interior surfaces of a load, the spool of the valve 98 is moved to the left as shown in FIG. 13, in which case the pump 94 delivers pressurized fluid to the conduit 116. The fluid passes through the valve 118, is divided into equal flow rates through the flow divider/combiner 114, and is fed through manifold conduits 50 and 51 to the respective piston and cylinder assemblies to open the arms 12. Simultaneously, fluid is exhausted from the piston and cylinder assemblies through the common manifold conduit 52, through check valve 106 which is opened by the pressure in conduit 116 sensed through pilot line 120, and through the valve 104, conduit 102 and valve 98 to the reservoir 96.

The valve assembly 56 includes a system for precisely limiting the maximum clamping force which can be applied by the clamp arms against the load, whether during closing or opening of the arms. With respect to clamp closure, this function is performed by the normally open, atmospherically-vented valve 104 interposed in conduit 102. Valve 104 is automatically closable in response to the pressure of fluid in conduit 102 by its pilot-operated interconnection through line 122 with the output of valve 124, which is adjustably settable to open in response to a predetermined pressure in conduit 102 sensed through pilot line 126. When valve 124 begins to open, fluid pressure in line 122 immediately closes valve 104 and thereby prevents any further supply of fluid to the piston and cylinder assemblies which would cause the load-handling arms 12 to close further. Any possible leakage across the spool of the valve 104 when closed is shunted to the conduit 116 through a small restriction 128 to ensure that no further fluid can be supplied to further close the arms 12 once the valve 104 has closed.

The adjustable predetermined pressure which causes valve 124 to open, and thus valve 104 to close, is independent of any variations in the pressure of fluid in the conduit 116 through which fluid is exhausted from the piston and cylinder assemblies while the arms 12 are closing. This is due to the fact that neither the output of valve 124, nor its spring cavity vent 124*a*, communicates with conduit 116. Rather both communicate with conduit 130, which is normally maintained at zero pressure regardless of the pressure in conduit 102 due to check valve 132, except when valve 124 has been opened. In contrast, if valve 124 or its spring cavity were vented to conduit 116, it would experience the influence of a variable pressure due to varying flow rates of fluid being exhausted through conduit 116, which flow rates vary with the operator's modulation of the control valve 98 to control the speed of the load arms 12, thereby uncontrollably varying the pressure setting of valve 124 and the output of fluid therefrom.

When control valve 98 is actuated by the operator to open the clamp arms 12, the maximum pressure of the fluid supplied through conduit 116 is likewise limited by the opening of valve 134 and the closing of valve 118 in response thereto, in the same manner described with respect to valves 124 and 104.

When either one of the valves 104 or 118 closes during actuation of the control valve 98, the output of the pump 94 empties through the relief valve 100 to the reservoir 96 until the operator centers the valve 98. Thereafter, when the operator moves the valve 98 to its opposite position to reverse the previous direction of actuation of the arms 12, the respective check valve 132 associated with the valve 104 or 118 is exposed to low pressure in its interconnected conduit 102 or 116 and thereby opens, exhausting the pressure tending to close the respective valve 104 or 118 and permitting the valve to open to allow fluid from the piston and cylinder assemblies to be exhausted therethrough.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide;

(d) said upper and lower pairs of slide guides being separated vertically by a space extending vertically substantially completely between said upper and lower pairs of slide guides and their associated slide members, said space being substantially centrally located along the length of said slide guides and being unoccupied by any said piston and cylinder assemblies so as to provide viewability through said space between the rearward and forward extremities of said load-handling structure.

2. The apparatus of claim 1 wherein each of said slide members at least partially surrounds the respective slide guide upon which the slide member is movably mounted.

3. The apparatus of claim 1 wherein each of said pair of slide guides with which said piston and cylinder assemblies are associated has fluid conduit means therein extending longitudinally thereof for conducting fluid to and from the respective piston and cylinder assembly therein.

4. The apparatus of claim 3 wherein said fluid conduit means are formed integrally in said slide guides.

5. The apparatus of claim 1, including two pairs of said piston and cylinder assemblies, each pair associated with a respective one of said upper and lower pairs of slide guides.

6. The apparatus of claim 1 wherein each of said piston and cylinder assemblies is connected movably to a respective slide member so as to permit relative pivoting movement between the piston and cylinder assembly and the slide member.

7. The apparatus of claim 1 wherein each of said piston and cylinder assemblies is connected movably to a respective slide member so as to permit relative vertical movement between the piston and cylinder assembly and the slide member.

8. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide;

(d) each of said slide members at least partially surrounding the respective slide guide upon which the slide member is movably mounted.

9. The apparatus of claim 8 wherein each of said pair of slide guides with which said piston and cylinder assemblies are associated has fluid conduit means therein extending longitudinally thereof for conducting fluid to and from said piston and cylinder assemblies.

10. The apparatus of claim 9, further including a fluid manifold vertically interconnecting said slide guides with which said piston and cylinder assemblies are associated and having fluid conduits operatively connected to said fluid conduit means.

11. The apparatus of claim 9 wherein said fluid conduit means are formed integrally in said slide guides.

12. The apparatus of claim 8, including two pairs of said piston and cylinder assemblies, each pair associated with a respective one of said upper and lower pairs of slide guides.

13. The apparatus of claim 8 wherein each of said piston and cylinder assemblies is connected movably to a respective slide member so as to permit relative pivoting movement between the piston and cylinder assembly and the slide member.

14. The apparatus of claim 8 wherein each of said piston and cylinder assemblies is connected movably to a respective slide member so as to permit relative vertical movement between the piston and cylinder assembly and the slide member.

15. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide;

(d) each of said one of said pairs of slide guides with which said piston and cylinder assemblies are associated having fluid conduit means therein extending longitudinally thereof exterior of the respective piston and cylinder assembly therein for conducting fluid to and from the respective piston and cylinder assembly.

16. The apparatus of claim 15 wherein each of said slide members at least partially surrounds the respective slide guide upon which the slide member is movably mounted.

17. The apparatus of claim 15, further including a fluid manifold vertically interconnecting said slide guides with which said piston and cylinder assemblies are associated and having fluid conduits operatively connected to said fluid conduit means.

18. The apparatus of claim 17 wherein said manifold and said slide guide frame are located rearwardly of said slide guides, and said manifold extends rearwardly to substantially no greater extent than said slide guide frame.

19. The apparatus of claim 17 wherein said slide guide frame includes two transversely spaced-apart frame sections interconnected transversely by said slide guides, said manifold being inserted transversely between said frame sections.

20. The apparatus of claim 15 wherein said fluid conduit means are formed integrally in said slide guides.

21. The apparatus of claim 15 wherein each of said slide guides with which said piston and cylinder assemblies are associated includes a circular bore formed integrally therein for housing the cylinder portion of one of said piston and cylinder assemblies.

22. The apparatus of claim 21, including a tube detachably lining said circular bore so as to be removable from said bore.

23. The apparatus of claim 15 wherein each of said piston and cylinder assemblies is connected movably to a respective slide member so as to permit relative pivoting movement between the piston and cylinder assembly and the slide member.

24. The apparatus of claim 15 wherein each of said piston and cylinder assemblies is connected movably to a respective slide member so as to permit relative vertical movement between the piston and cylinder assembly and the slide member.

25. The apparatus of claim 15, including two pairs of said piston and cylinder assemblies, each pair associated with a respective one of said upper and lower pairs of slide guides.

26. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide;

(d) valve means operatively interconnected with said piston and cylinder assemblies for controlling the flow of fluid to and from said piston and cylinder assemblies, said valve means being located vertically between said respective upper and lower pairs of slide guides in forwardly overlapping relationship thereto and off-center relative to the length of said slide guides.

27. The apparatus of claim 26 wherein said valve means extends forwardly to substantially no greater extent than said slide members.

28. The apparatus of claim 26, further including a fluid manifold vertically interconnecting said slide guides with which said piston and cylinder assemblies are associated and having fluid conduits operatively connected to said piston and cylinder assemblies, said valve means being mounted on said fluid manifold and extending forwardly therefrom.

29. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide;

(d) each of said piston and cylinder assemblies being connected substantially immovably to the respective slide guide within which the piston and cylinder assembly is located, and being connected movably to the respective slide member mounted on said respective slide guide so as to permit relative movement between the piston and cylinder assembly and the slide member.

30. The apparatus of claim 29 wherein each of said slide guides within which one of said piston and cylinder assemblies is located includes a circular bore formed integrally therein for housing the cylinder portion of the respective one of said piston and cylinder assemblies.

31. The apparatus of claim 30, including a tube detachably lining said circular bore so as to be removable from said bore.

32. The apparatus of claim 29 wherein each of said piston and cylinder assemblies is connected movably to said respective slide member so as to permit relative pivoting movement between the piston and cylinder assembly and the slide member.

33. The apparatus of claim 29 wherein each of said piston and cylinder assemblies is connected movably to said respective slide member so as to permit relative vertical movement between the piston and cylinder assembly and the slide member.

34. The apparatus of claim 29 wherein each of said pair of slide guides with which said piston and cylinder assemblies are associated has fluid conduit means therein extending longitudinally thereof exterior of the respective piston and cylinder assembly therein for conducting fluid to and from the respective piston and cylinder assembly.

35. The apparatus of claim 34, further including a fluid manifold vertically interconnecting said pair of slide guides with which said piston and cylinder assemblies are associated and having fluid conduits operatively connected to said fluid conduit means.

36. The apparatus of claim 34 wherein said fluid conduit means are formed integrally in said slide guides.

37. The apparatus of claim 29, including two pairs of said piston and cylinder assemblies, each pair associated with a respective one of said upper and lower pairs of slide guides.

38. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide;

(d) each of said one of said pairs of slide guides with which said piston and cylinder assemblies are associated being at least partially surrounded by a respective slide member, and having a length greater than the fully retracted length of the respective piston and cylinder assembly therein so that an end portion of the slide guide projects beyond said fully retracted length, said end portion having a cross-sectional area smaller than that of another portion of the slide guide which at least partially surrounds the respective piston and cylinder assembly.

39. The apparatus of claim 38 wherein said portion of the slide guide which at least partially surrounds the respective piston and cylinder assembly substantially immovably mounts the piston and cylinder assembly within the slide guide.

40. The apparatus of claim 38 wherein said portion of the slide guide which at least partially surrounds the respective piston and cylinder assembly includes a circular bore formed integrally therein for housing the cylinder portion of the respective piston and cylinder assembly.

41. A load-handling structure adapted to be mounted on an elevatable load carriage at the front of a lift truck for operating transversely openable and closable load-handling arms, said load-handling structure comprising:

(a) a slide guide frame, adapted to be mounted vertically on the load carriage, having respective upper and lower pairs of elongate, parallel, vertically-spaced transverse slide guides thereon;

(b) a respective pair of elongate vertically-spaced slide members longitudinally movably mounted on each of said respective upper and lower pairs of transverse slide guides for supporting said load-handling arms, each pair of slide members being longitudinally movable alternatively toward or away from one another in a mutually-overlapping longitudinal relationship;

(c) a pair of selectively extensible and retractable fluid power piston and cylinder assemblies associated with at least one of said upper and lower pairs of slide guides, each of said piston and cylinder assemblies being at least partially surrounded by a respective guide of said one of said pairs of slide guides and being connected to the respective slide member mounted thereon so as to move the respective slide member longitudinally relative to the respective guide; and (d) a fluid manifold vertically interconnecting said slide guides with which said piston and cylinder assemblies are associated and having fluid conduits operatively connected to said piston and cylinder assemblies.

42. The apparatus of claim 41, including two pairs of said piston and cylinder assemblies, each pair associated with a respective one of said upper and lower pairs of slide guides, said fluid manifold vertically interconnecting said upper and lower pairs of slide guides and having fluid conduits operatively connected to said two pairs of piston and cylinder assemblies.

43. The apparatus of claim 41 wherein said fluid manifold is located off-center relative to the length of said slide guides.

44. The apparatus of claim 41 wherein said manifold and said slide guide frame are located rearwardly of said slide guides, and said manifold extends rearwardly to substantially no greater extent than said slide guide frame.

45. The apparatus of claim 41 wherein said slide guide frame includes two transversely spaced-apart frame sections interconnected transversely by said slide guides, said manifold being inserted transversely between said frame sections.

* * * * *

UNITED STATES PATENT AND TRADEMARK OFFICE

CERTIFICATE OF CORRECTION

PATENT NO. : 5,336,039

DATED : August 9, 1994

INVENTOR(S) : Marshall K. House

It is certified that error appears in the above-identified patent and that said Letters Patent is hereby corrected as shown below:

Col. 5, line 46 Change "con,non" to --common--

Col. 7, line 28 After "shown" delete "25"

Signed and Sealed this

Twenty-fifth Day of October, 1994

*Attest:*

*Attesting Officer*

Bruce Lehman

BRUCE LEHMAN

*Commissioner of Patents and Trademarks*